United States Patent [19]

Szymber

[11] 3,989,519

[45] Nov. 2, 1976

[54] MEANS FOR IMPROVING THE CONTRAST OF AN ELECTROSTATIC LATENT IMAGE

[75] Inventor: Oleg Szymber, Elk Grove, Ill.

[73] Assignee: GAF Corporation, New York, N.Y.

[22] Filed: Sept. 3, 1974

[21] Appl. No.: 502,628

[52] U.S. Cl. ..... 96/1 R; 317/262 A; 96/1 TE

[51] Int. Cl.[2] ..... G03G 13/14

[58] Field of Search ..... 96/1 C, 1 TE, 1 R; 317/262; 250/49.5

[56] References Cited

UNITED STATES PATENTS

| | | | |
|---|---|---|---|
| 2,825,814 | 3/1958 | Walkup | 317/262 |
| 3,057,275 | 10/1962 | Walkup et al. | 96/1 TE |
| 3,370,212 | 2/1968 | Frank | 317/262 A |

FOREIGN PATENTS OR APPLICATIONS

| | | | |
|---|---|---|---|
| 375,995 | 1962 | Japan | 96/1 C |

*Primary Examiner*—David Klein
*Assistant Examiner*—John L. Goodrow
*Attorney, Agent, or Firm*—Walter C. Kehm; Arthur Dresner

[57] ABSTRACT

A method for the contrast enhancement of an electrostatic latent image in a TESI-type system or the like, which comprises positioning a photoconductive member adjacent a dielectric surface, and applying an electrical potential between the photoconductive member and dielectric surface while irradiating selected portions of the photoconductive member, to cause electric charge formation on selected portions of the dielectric surface corresponding to the irradiated portions of the photoconductive member. In accordance with this invention, the electrical potential is applied as a plurality of discrete pulses, the pulses of applied electrical potential being separated by time periods in which the applied potential is essentially zero. By this method, the relative electric charge density in the selected portions of the dielectric surface is increased over any electric charge density in the portions of the dielectric surface which do not correspond to the irradiated photoconductive member portions.

11 Claims, 2 Drawing Figures

MEANS FOR IMPROVING THE CONTRAST OF AN ELECTROSTATIC LATENT IMAGE

BACKGROUND OF THE INVENTION

The well-known TESI (Transfer of Electrostatic Image) system of photoreproduction utilizes the creation of a latent, electrostatic image on a dielectric surface. This image comprises zones of electric charge selectively laid down on the surface of the dielectric sheet. After production of the electrostatic image, the electrostatic image surface is brought into contact with a toner material such as carbon black in combination with an adhesive resin, under such conditions that the toner material adheres to the electrostatically-charged portions of the dielectric surface, and does not adhere to the remaining portions. Accordingly, a visible image is formed on the dielectric surface.

A large amount of research has been invested into the TESI process, as well as other processes involving the creation of an electrostatic latent image on a dielectric surface. Examples of patents relating to this area of technology include: Carlson, et al. U.S. Pat. No. 2,982,647, Schaffert U.S. Pat. No. 3,147,679, Robinson U.S. Pat. No. 3,598,579, and the prior art of record in those patents.

In the TESI process, light is shined through a negative onto a photoconductive electrode. The light-transmitting portions of the negative permit activation of the light-irradiated portions of the photoconductive electrode, causing its electrical resistance to decrease. As a result of this, electrical current can selectively flow through the irradiated portions of the electrode across a small air gap of micronic size, to charge portions of the dielectric surface directly adjacent to the conducting portions of the photoconductive electrode.

However, the TESI process has not achieved notable commercial success, due to certain drawbacks, one of which is that the prior art systems have not been always capable of providing good, clear copies of negatives which exhibit relatively low contrast, such as diazo negatives, vesicular negatives and some silver negatives.

A need therefore exists to improve the TESI process, as well as other processes involving the creation of an electrostatic latent image, by enhancing the contrast of latent images. This can be done by increasing the electric charge density in the charged areas of the electrostatic latent images, relative to the uncharged areas of the image. When this is done, and toner is applied to the image, improved visual contrast can be obtained.

DESCRIPTION OF THE INVENTION

This invention relates to a method of contrast enhancement of an electrostatic, latent image on a dielectric surface which comprises: positioning a photoconductive member adjacent the dielectric surface and applying an electrical potential between the photoconductive member and the dielectric surface, while irradiating selected portions of the photoconductive member, to cause electric charge formation on selected portions of the dielectric surface corresponding to the irradiated, photoconductive member portions. In accordance with this invention, the above electrical potential is applied as a plurality of discrete pulses of similar polarity. The pulses of electrical potential are separated by time periods in which the applied electrical potential is essentially zero. These time periods of zero applied electrical potential preferably have an average duration which is longer than the average duration of the pulses.

As a result of this, the relative density of an electrical charge in the selected portions of the dielectric surface is increased by the plural pulses over any electric charge density which may exist in the portions of the dielectric surface which do not correspond with the irradiated, photoconductive member portions. Each pulse of electrical potential increases the differential charge density between the charged portions of the dielectric surface and the uncharged portions. This in turn results in greater contrast when toner solution or the like is applied to the electrostatic image in any conventional manner.

It is generally desirable for the pulses of electrical potential to each have a duration of 5 milliseconds to about 200 milliseconds. Correspondingly, the time periods of zero applied electrical potential preferably each have a duration of at least about four times the duration of the pulses used. In actuality, it is desirable for the periods of zero applied electrical potential to be as long as possible, and may range up to a few seconds or more, subject to the time available for the process, it being generally preferable for a commercial reproduction process to have a total duration of only about a second.

The invention of this application is particularly applicable to the TESI processes, in which a major portion of the area of the photoconductive member is spaced from the dielectric surface by about 5 to 20 microns, to provide an air gap therebetween. This is generally done by the use of selectively roughened dielectric paper, which serves as a combination image-receiving dielectric surface, yet which provides intermittent spacing by the peaks of roughness on the paper itself. Such paper is well-known to the art and is available from the Weyerhauser Company as Type M dielectric-coated paper. One other type of such paper is described in U.S. Pat. No. 3,519,819.

Under the conditions described above, the pulses of electrical potential utilized herein preferably have a maximum potential of from 500 to 800 volts.

Preferably, each of the pulses of electrical potential has a duration of about 30 to 100 milliseconds, and the time periods of zero applied potential have a duration of about 200 to 400 milliseconds. Therefore, a desirable pulse may have a duration of about 40 milliseconds with the time periods of disconnected potential between pulses being about 200 to 300 milliseconds. Preferably, at least four of such pulses are applied.

Other excellent process conditions include a series of pulses of electrical potential having a duration of about 100 milliseconds, spaced by time periods of about 200 milliseconds or longer during which the potential is brought to essentially zero. Generally, four or more pulses are desirable.

Another set of process conditions which yield excellent results, but which may be excessively long in duration for some commercial purposes, involves a series of about 10 or more pulses of electrical potential, each pulse having a duration of only about 10 milliseconds each, separated by periods of 100 to 200 milliseconds, during which the potential is brought to essentially zero.

An energy flux of illumination on the surface of the photoconductor of about 0.1 to 0.2 microwatt.second per square centimeter per pulse of electrical potential is generally suitable (e.g., about 0.14 microwatt-.second/cm$^2$).

Referring to the drawings.

Figure 1:
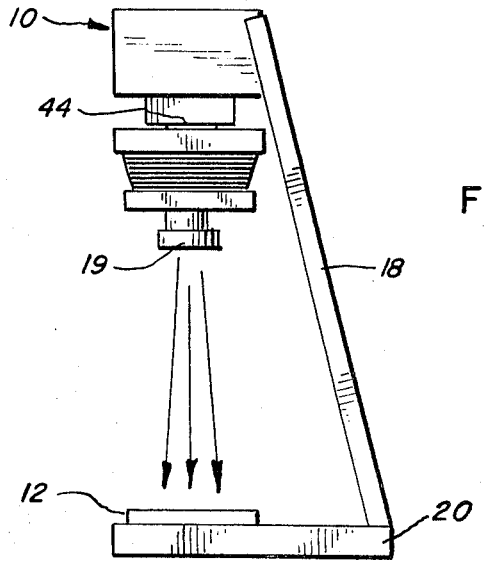
FIG. 1 is a schematic view of apparatus for performing the method of this application in conjunction with a TESI process.
Figure 2:
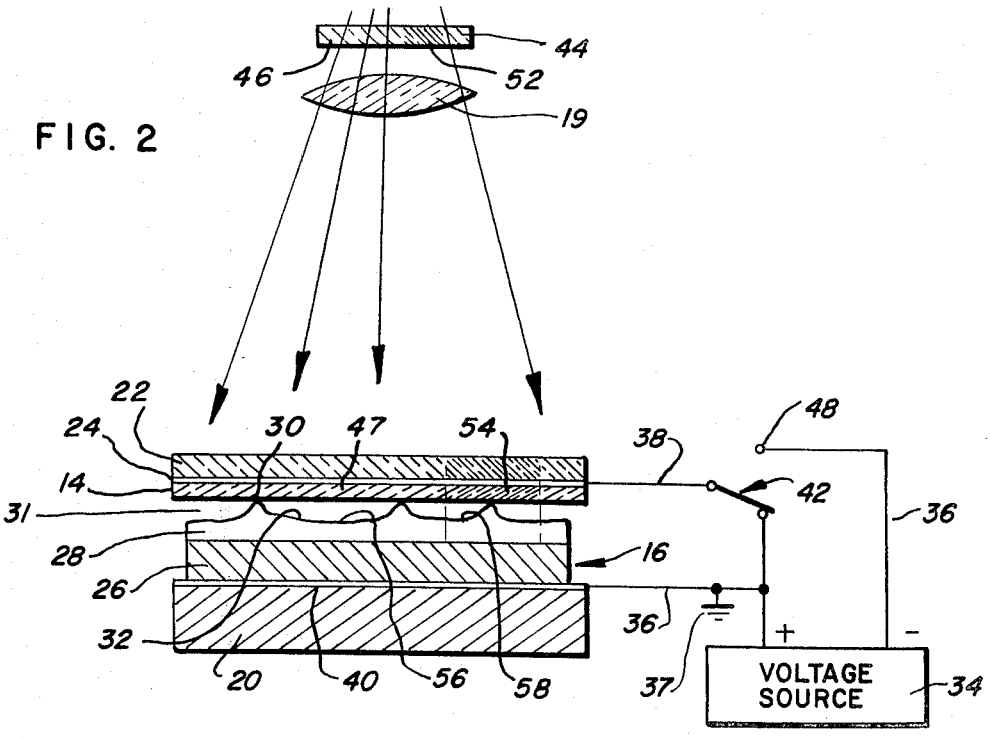
FIG. 2 is a schematic sectional view, greatly enlarged, of the dielectric member, the photoconductive electrode, and associated parts.

Referring to FIGS. 1 and 2, the overall apparatus of this invention is shown schematically, including a focusing light source 10 for illuminating stack 12, which includes photoconductive electrode 14, and dielectric sheet 16.

Light source 10 is positioned over stack 12 by a support 18, which is attached to a stand 20 upon which stack 12 rests. Lens 19 provides focused light, which has passed through a negative, as described below.

Referring in particular to FIG. 2, a greatly magnified, schematic view of stack 12 is shown. Photoconductor 14 may be made in accordance with Canadian Pat. No. 891,424, and constitutes a plate which may be attached to a glass or a clear plastic layer 22 through transparent, conductive layer 24. Transparent conductive layer 24 may be manufactured in accordance with U.S. Pat. No. 3,674,711 or may comprise a fused tin oxide sold under the trademark NESA by the Pittsburgh Plate Glass Company.

Dielectric sheeting 16 is shown in this embodiment to include a paper layer 26, which is coated on its upper side with a dielectric layer 28, about 5 microns in thickness. The dielectric material may be a pigmented polyvinyl butyral, such as Butvar 72A of Varian Associates, containing pigments such as barium oxide, zinc oxide, and silicon dioxide. Alternatively, the polyvinyl butyral resin may be replaced in whole or in part with polyvinyl acetate resin, containing similar pigments.

Preferably, the dielectric layer is slightly roughened to define peaks 30, which provide an air gap 31 spacing for most of the dielectric sheeting surface 32 from the underside of the photoconductor 14. Peaks 30 may be about 7 microns high to space sheeting 16 from photoconductive electrode 14, and provide an air gap of that thickness. Generally, air gap 31 is no larger than 15–20 microns, and may be as small, on the average, as about 5 microns, and may in fact go to 2020.

A voltage source 34 is adapted to provide a D.C. potential through conductor lines 36, 38 between transparent conductor 24, and dielectric sheeting 16 through conductor sheet 40, which may overlie base 20, on upon which dielectric sheeting 16 rests. A line 36 is connected to ground 37. Any appropriate switching means 42 may be provided, to permit the selective application of direct current voltage between photoconductor 14 via transparent conductor 24, and dielectric sheeting 16, and also to permit "shorting out" or grounding of said pulses of voltage for the desired time period. A switch such as Type "C" relay switch with a Hewlett-Packard pulse generator has been found to be suitable for use herein.

A transparent image negative 44 is mounted in light source 10 between the light source and lens 19, to project a focused image on stack 12. The negative 44 contains the image which is desired to be reproduced.

Accordingly, light 10 (typically using a quartz-lined, 150-watt bulb with a 24 volt filament and a 4–96 filter sold by the Corning Glass Company as a light source), is illuminated to irradiate negative 44. Some portions 46 of negative 44 are clear and light-transmitting, so that the light passes through transparent glass or plastic layer 22 and transparent conductor 24, to irradiate some portions 47 of photoconductor 14. Other portions 52 of negative 44 are light-reflecting or absorbing, so that corresponding portions 54 of photoconductor 14 are not irradiated.

For preparation of an electrostatic image, switch 42 is closed against terminal 48, to provide a pulse of electrical potential across air gap 31. In the irradiated portions 47 of photoconductor 14, the electrical resistance through such irradiated portion 47 drops sufficiently to quickly permit voltage source 34 to impart an electrical potential across air gap 31 which exceeds its Paschen voltage. A "Paschen voltage" is the minimum voltage necessary to permit electric charge to be transferred across air gap 31 from photoconductor 14 to dielectric layer 28. Under the conditions specified above, the Paschen voltage of the specific embodiment shown herein is about 350 volts, while voltage source 34 provides approximately 650 volts to the circuit. Accordingly, in the illuminated or irradiated areas 47 of photoconductor 14, charge will transfer across air gap 31 with each pulse of voltage provided, until equilibrium is achieved.

Corresponding to the dark, light-absorbing portions 52 of negative 44, the non-illuminated portions or areas 54 of photoconductor 14 retain a high resistance. Accordingly, because of the additional resistance, the voltage build-up across air gap 31 adjacent non-illuminated areas 54 of the photoconductive electrode proceeds at a much slower rate. Accordingly, the voltage of source 34, and each pulse time, is adjusted to provide a condition of charge flow from the illuminated areas of the photoconductive electrode, while minimizing or eliminating the flow of charge from non-illuminated areas 54 of electrode 14.

Accordingly, an electrostatic image may be formed in which charge is laid down on selected portions 56 of dielectric surface 28, corresponding to irradiated photoconductive member portions 47, while little or no charge is transmitted to the areas 58 of the dielectric surface corresponding to non-illuminated areas 54 of the photoconductive member.

Describing in detail the process of this invention, an exemplary series of four or more 40-millisecond pulses of applied potential (caused by proper positioning of switch 42) are separated by 200-millisecond periods of zero applied potential (caused by switch 42 being changed to the position shown in FIG. 2).

During the first 40-millisecond period of applied potential, switch 42 is placed in one position to provide a 650-volt potential across the system.

The voltage between illuminated areas 47 and surface 56 rises much more rapidly than the voltage between non-illuminated areas 54 and surface 58, as a result of the decreased resistance of the illuminated areas 47 of photoconductor 14. When the air gap potential difference reaches about 350 volts, the voltage ceases to rise, since the Paschen voltage has been achieved, and current flows across air gap 31 to charge adjacent portions 56 of dielectric surface 28.

During the first 40-millisecond period, the voltage across air gap 31 adjacent the non-illuminated areas 54 of photoconductor 14 also rises, but relatively slowly, due to the high resistance of non-illuminated areas 54. However, before the Paschen voltage is reached by non-illuminated areas 54, the electrical potential is reduced to zero by switch 42 (at the end of the 40-millisecond period), which causes a drop of the voltages across air gap 31 during the first 200-millisecond period of zero applied potential, especially when photoconductive member 14 is grounded, as at ground 37. After this 200-millisecond period has elapsed, the voltages across air gap 31 have dropped without permitting current flow across air gap 31 adjacent areas 54. Thereafter, a second pulse of D.C. voltage is applied to the system for a second 40-millisecond period.

Once again, during this period, the voltage across air gap 31 adjacent illuminated areas 47 rises more quickly than the corresponding voltage across non-illuminated areas 54, so that the Paschen voltage is reached by areas 47, and another pulse of electric current passes across air gap 31 to dielectric surface 56.

At the end of the second 40-millisecond time period, another 200-millisecond time period of zero applied potential is provided, to permit the respective voltages to once again drop.

A third 40-millisecond period of electrical potential and a subsequent period of zero applied potential of at least 200-milliseconds duration can be applied and the above series of applied pulses can be repeated as many times as desired, preferably at least four times.

As a result of the above pulsed pattern of application of electric charge, it can be seen that a series of charge pulses are transferred across air gap 31 without any charge in significant amount being transferred from non-illuminated portions 54 of photoconductive member 14. Accordingly, it can be seen that charge can be transferred across air gap 31, with each pulse providing to dielectric surface 56 an added amount of electric charge, at least until the charge density becomes so great as to prevent voltage across air gap 31 from exceeding the Paschen voltage, which would delineate the theoretical maximum amount of charge that could be placed upon dielectric surface 56.

When one considers the prior art technique of applying a single pulse of voltage to charge a spaced, dielectric sheet, it can be seen that the length of the pulse of voltage which can be applied is limited, if one wishes to avoid the flow of charge from non-illuminated portions 54 of the photoconductive electrode member. If permitted, the voltage across air gap 31 at portions or areas 54 could rise to the Paschen voltage, to cause the transfer of charge into portions 58 of the dielectric sheet, where charge transfer must be avoided for obtaining the desired photocopy. Accordingly, the amount of charge which can be supplied to dielectric surface 56 in a single pulse is limited. However, with the plural pulse charge application system provided in accordance with this invention, there is believed to be no limitation of the charge density that can be applied to surface 56, except for the limitation of its intrinsic charge-holding capacity.

As a result of this, the process of this invention permits the dark areas of the resulting photocopy to be darker, as a function of an increased charge of the latent image, while the light areas remain light for providing increased contrast, even when the negative itself is a low contrast negative.

The above has been offered for illustrative purposes only, and is not to be considered as limiting the invention of this application, which is as defined in the claims below.

That which is claimed is:

1. In a method for the contrast enhancement of an electrostatic latent image on a dielectric surface which comprises: positioning a photoconductive member adjacent said dielectric surface in a manner forming an air gap therebetween, applying an electrical potential between said photoconductive member and said dielectric surface, and irradiating selected portions of said photoconductive member, to cause electric charge formation on selected portions of said dielectric surface corresponding to said irradiated photoconductive member portions as a result of charge transfer between said photoconductive member and said dielectric when the voltage drop across said air gap bounded by facing surfaces of said photoconductive member and said dielectric exceeds a predetermined minimum value; the improvement comprising:

applying said electrical potential as a plurality of discrete pulses of similar polarity, said pulses being of a duration such that said voltage drop across said air gap will exceed said predetermined minimum value in the selected irradiated portions of said photoconductor and will be below said predetermined minimum value in the non-irradiated portions thereof, said pulses of electrical potential being separated by time periods in which said applied electrical potential is essentially zero, said latter periods having an average duration of at least the average duration of said pulses, whereby the relative density of electric charge in said selected portions of the dielectric surface is increased by said plurality of pulses over any electric charge density in the portions of said dielectric surface which do not correspond with the irradiated photoconductive member portions.

2. The method of claim 1 in which said photoconductive member is grounded during said periods of zero applied potential.

3. The method of claim 2 in which essentially all of said pulses of electrical potential each have a duration of 5 to 200 milliseconds.

4. The method of claim 3 in which essentially all of said time periods of zero applied potential each have a duration of at least four times the duration of said pulses.

5. The method of claim 4 in which a major portion of the area of said photoconductive member is spaced from said dielectric surface by 5 to 20 microns, to provide an air gap therebetween.

6. The method of claim 5 in which said pulsed electrical potential has a maximum potential of from 500 to 800 volts.

7. The method of claim 6 in which said irradiation is provided by visible light having an energy flux of 0.1 to 0.2 microwatt.second per square centimeter per pulse of electrical potential.

8. The method of claim 7 in which said pulse has a duration of about 30 to 100 milliseconds; said time periods of essentially zero potential have a duration of about 200 to 400 milliseconds; and at least four of said pulses are applied.

9. The method of claim 8 in which each said pulse has a duration of about 40 milliseconds; said time periods of substantially zero potential have a duration of about 200 to 300 milliseconds.

10. The method of claim 7 in which each said pulse has a duration of 30 to 100 milliseconds, and said time periods of substantially zero potential are each at least four times the length of a said pulse.

11. The method of claim 7 in which said selected portions of the photoconductive member are irradiated by passing irradiating light through a low contrast negative.

* * * * *